US006859176B2

(12) United States Patent
Choi

(10) Patent No.: US 6,859,176 B2
(45) Date of Patent: Feb. 22, 2005

(54) DUAL-BAND OMNIDIRECTIONAL ANTENNA FOR WIRELESS LOCAL AREA NETWORK

(75) Inventor: Jong-In Choi, Seoul (KR)

(73) Assignees: Sunwoo Communication Co., Ltd.; Institute Information Technology Assessment (KR)

( * ) Notice: Subject to any disclaimer, the term of this patent is extended or adjusted under 35 U.S.C. 154(b) by 70 days.

(21) Appl. No.: 10/391,358

(22) Filed: Mar. 18, 2003

(65) Prior Publication Data

US 2004/0183727 A1 Sep. 23, 2004

(51) Int. Cl.[7] ..... H01Q 1/38; H01Q 9/28

(52) U.S. Cl. ..... 343/700 MS; 343/795; 343/730

(58) Field of Search ..... 343/700 MS, 793, 343/795, 797, 729, 783, 893, 859, 730; H01Q 1/38, 9/28

(56) References Cited

U.S. PATENT DOCUMENTS

| | | | | |
|---|---|---|---|---|
| 5,754,145 | A | 5/1998 | Evans | 343/795 |
| 5,757,333 | A | 5/1998 | Kitchener | 343/826 |
| 5,867,130 | A | 2/1999 | Tay et al. | 343/795 |
| 6,031,503 | A | 2/2000 | Preiss et al. | 343/770 |
| 6,252,561 | B1 | 6/2001 | Wu et al. | 343/866 |
| 6,339,404 | B1 | 1/2002 | Johnson et al. | 343/794 |
| 6,346,919 | B1 | 2/2002 | Wang et al. | 343/767 |
| 6,404,394 | B1 | 6/2002 | Hill | 343/702 |
| 6,747,605 | B2 * | 6/2004 | Lebaric et al. | 343/795 |
| 2004/0017315 | A1 * | 1/2004 | Fang et al. | 343/700 MS |
| 2004/0056805 | A1 * | 3/2004 | Chen | 343/700 MS |
| 2004/0075609 | A1 * | 4/2004 | Li | 343/700 MS |
| 2004/0113858 | A1 * | 6/2004 | Tsai et al. | 343/792 |

* cited by examiner

*Primary Examiner*—Wilson Lee
*Assistant Examiner*—Trinh Vo Dinh
(74) *Attorney, Agent, or Firm*—Piper Rudnick LLP

(57) ABSTRACT

The present invention relates to a dual-band omnidirectional antenna for wireless LANs. The antenna has a planar dielectric substrate, and first and second conductive patterns. The planar dielectric substrate has two parallel surfaces. The first conductive pattern is arranged on one surface of the substrate, and is provided with a first feeder line arranged on a longitudinal central line of the substrate and a plurality of radiating elements connected to the first feeder line and designed such that some of them operate in a high frequency band (4.9 to 5.85 GHz frequency band), and others thereof operate in a low frequency band (2.4 to 2.5 GHz frequency band). The second conductive pattern is arranged on the other surface of the substrate, and provided with a second feeder line arranged on a longitudinal central line of the substrate and a plurality of radiating elements connected to the second feeder line arid up-down symmetrically arranged with respect to the radiating elements on the first conductive pattern.

8 Claims, 7 Drawing Sheets

DUAL-BAND OMNIDIRECTIONAL ANTENNA FOR WIRELESS LOCAL AREA NETWORK

BACKGROUND OF THE INVENTION

1. Field of the Invention

The present invention relates generally to antennas used in wireless local area networks, and more particularly to a dual-band omnidirectional antenna, which has dual-band operating characteristics enabling the antenna to operate in two different frequency bands and omnidirectional radiation characteristics in each of the frequency bands.

2. Description of the Prior Art

Generally, Wireless Local Area Networks (WLANs) are used to transmit and receive digitally formatted data in a wireless manner between areas in a building, between different buildings, or between a building and an external area using wireless communication devices. In WLAN systems, antennas which operate in corresponding frequency bands are required for wireless communication devices.

Meanwhile, WLAN systems are classified into an Institute of Electrical and Electronics Engineers (IEEE) 802.11b system in which a representative operating frequency is 2.4 GHz and an IEEE 802.11a system in which a representative operating frequency is 5.725 GHz, depending on international standards for operating frequencies. Further, each wireless communication device currently used in WLAN systems is generally provided with two antennas. That is, one antenna operating in the 2 GHz frequency band, and the other antenna operating in the 5 GHz frequency band are separately provided. Such a double-antenna structure is designed to enable the wireless communication device to be compatibly used in both the two WLAN systems, but it is very disadvantageous in structural and economic aspects. Accordingly, there is urgently required an antenna capable of being compatibly used in both the two WLAN systems, that is, a so-called dual-band antenna capable of operating in different frequency hands used in the two WLAN systems.

Meanwhile, the WLAN systems enable communications between different devices, such as between personal computers, between a personal computer and a server, between a personal computer and a printer, etc. In this case, individual stations can be randomly located, in relation to other integrated stations. Therefore, the dual-band antenna must have omidirectionality.

In the prior art related to antennas, a ceramic patch antenna designed to have dual-band operating characteristics is disclosed. The patch antenna typically comprises a ceramic substrate, a metalized patch formed on one surface of the ceramic substrate, and a ground plane arranged on an opposite surface thereof. While the ceramic patch antenna can be actually miniaturized, it is very expensive relative to a dipole antenna. Further, the ceramic patch antenna requires special connector and cable, and the requirement for the special connector and cable is accompanied with a burden of additional installation costs. Especially, since the patch antenna has directional radiation characteristics, it is not suitable for wireless LANs requiring omnidirectional radiation characteristics.

SUMMARY OF THE INVENTION

Accordingly, the present invent on has been made keeping in mind the above problems occurring in the prior art, and an object of the present invention is to provide a dual-band omnidirectional antenna, which has dual-band operating characteristics enabling the antenna to effectively operate in different frequency bands and omnidirectional radiation characteristics in each of the frequency bands.

Another object of the present invention is to provide a dual-band omnidirectional antenna, which can be miniaturized and manufactured at low cost and which is convenient to install.

In order to accomplish the above object, the present invention provides a dual-band omnidirectional antenna (hereinafter referred to as "antenna"), which is used together with a wireless communication device in a wireless LAN system. The antenna comprises a planar dielectric substrate, and two conductive patterns arranged on both surfaces of the planar dielectric substrate. Each of the conductive patterns includes a feeder line arranged on a longitudinal central line of the substrate, and radiating elements arranged on the left and right of the feeder line. On each of the conductive patterns, radiating elements designed to operate in a high frequency band and radiating elements designed to operate in a low frequency band are arranged in a suitable form. A feeding part is a feeding hole formed to pass through the opposite two feeder lines and the substrate therebetween. A single coaxial transmission cable is provided to the antenna such that its external conductor comes into contact with the feeder line on one conductive pattern, and its core comes into contact with the other feeder line on the other conductive pattern by passing through the feeding hole.

The antenna has dual-band operating characteristics enabling the antenna to effectively operate in two different frequency bands and omnidirectional radiation characteristics in each of the frequency bands. Further, the antenna can be miniaturized to such an extent that it can be installed within a wireless communication device as well as outside it.

BRIEF DESCRIPTION OF THE DRAWINGS

The above and other objects, features and other advantages of the present invention will be more clearly understood from the following detailed description taken in conjunction with the accompanying drawings, in which:

FIGS. 6*a* and 6*b* are views showing results obtained by measuring radiation patterns of the antenna of FIG. 1 at a frequency of 2.4 GHz, wherein FIG. 6*a* shows a horizontal radiation pattern and FIG. 6*b* shows a vertical radiation pattern; and FIGS. 7*a* and 7*b* are views showing results obtained by measuring radiation patterns of the antenna of FIG. 1 at a frequency of 5.75 GHz, wherein FIG. 7*a* shows a horizontal radiation pattern and FIG. 7*b* shows a vertical radiation pattern.

DESCRIPTION OF THE PREFERRED EMBODIMENTS

Figure 1:
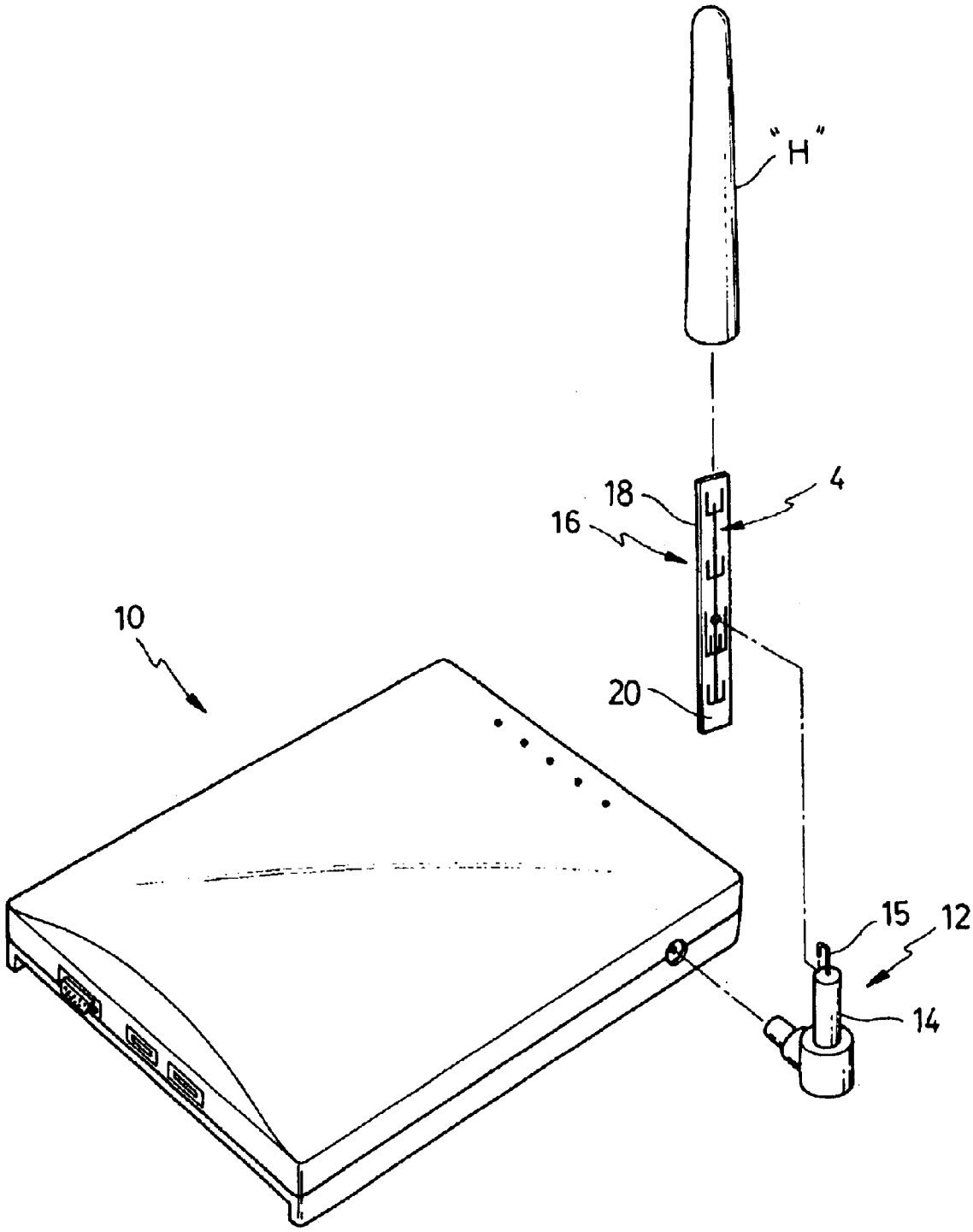
FIG. 1 is a perspective view of a wireless LAN device using an antenna according to a preferred embodiment of the present invention.

FIG. 1 shows a wireless communication device 10 using an antenna 16 according to the present invention. A wireless LAN system comprises a computer, a printer and other devices having LAN functions, as well as the wireless communication device 10. FIG. 1 illustrates that the antenna 16 is installed outside the wireless communication device 10 and is protected by a housing H. However, the antenna 16 is planar and can be miniaturized, so it can be installed within the wireless communication device 10.

The antenna 16 comprises a dielectric substrate 18 with front and rear surfaces on which conductive patterns 24 and 36 can be arranged, respectively. The dielectric substrate 18 has a relative dielectric constant of 1 to 10, preferably, 4.5, and has a predetermined Thickness, preferably, a value of 1.5 to 2.5 mm. The substrate 18 can be characterized in that it is planar and has a front surface 20 and a rear surface 22 which are actually parallel with each other and on which the conductive patterns 24 and 36 are arranged, respectively.

The above-described conductive patterns 24 and 36 are each formed through a typical etching technique in which each of the surfaces of the substrate 18 is coated with a copper film with a thickness of approximately 0.2 to 0.3 nm, an unnecessary part is chemically corroded to be eliminated, and only a required pattern is left on the substrate 18. However, the conductive patterns 24 and 36 can also be arranged using typical wire conductors.

Figure 2:
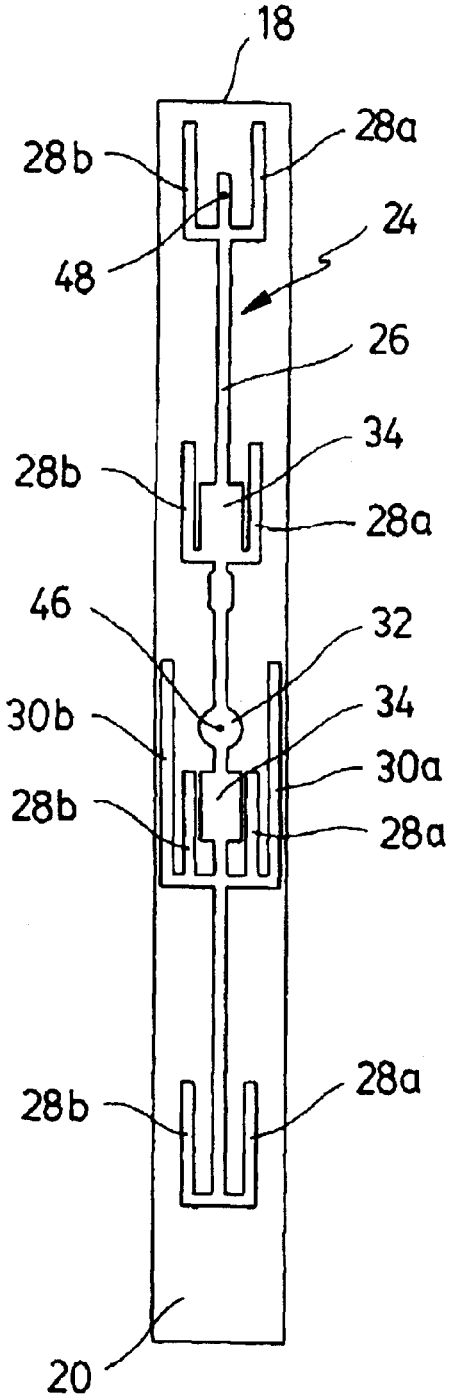
FIG. 2 is a front elevation view of the antenna of FIG. 1.
Figure 3:
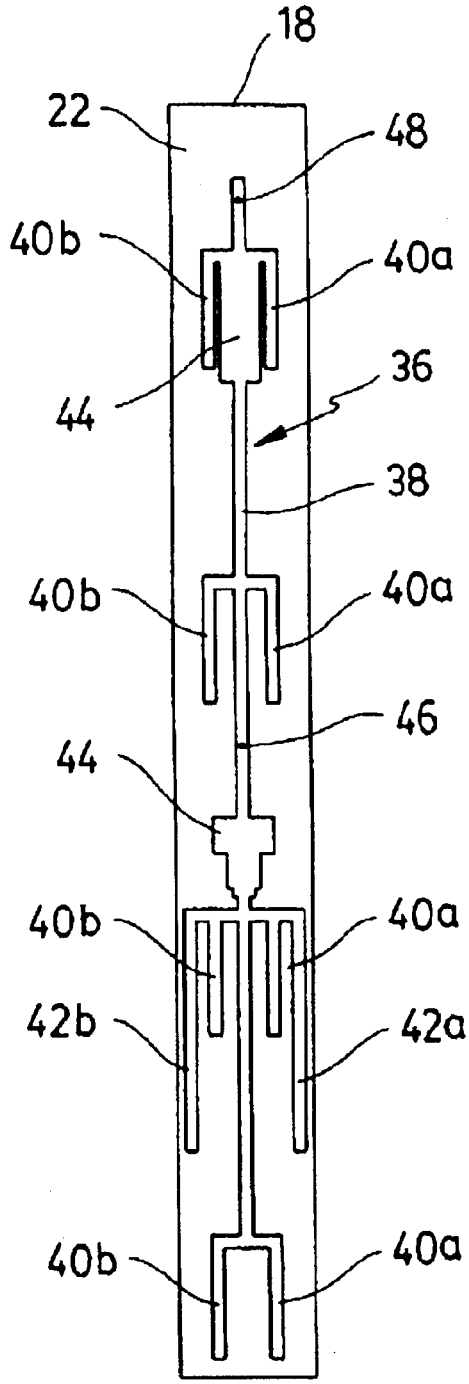
FIG. 3 is a rear elevation view of the antenna of FIG. 1.
Figure 4:
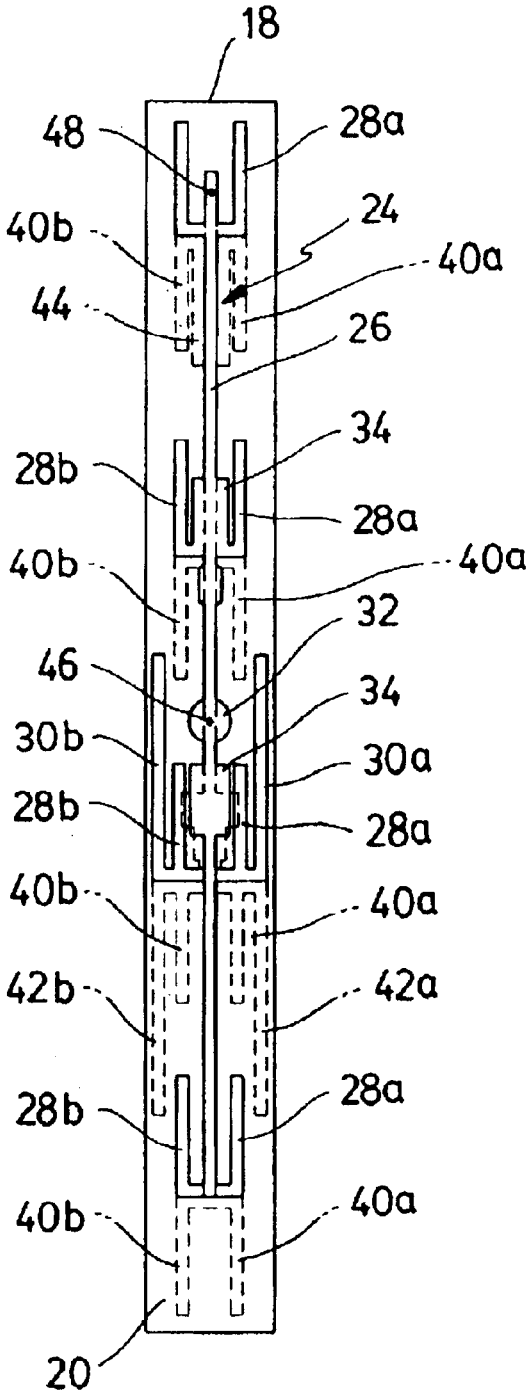
FIG. 4 is a front elevation view of the antenna of FIG. 1 with the rear part thereof depicted by imaginary lines.

In FIGS. 2 to 4, the conductive patterns 24 and 36 are depicted in detail. Referring to FIG. 2, the first conductive pattern 24 arranged on the front surface 20 of the substrate 18 comprises a first feeder line 26 arranged on a longitudinal central line of the substrate 18, a plurality of radiating elements 28*a*, 28*b*, 30*a* and 30*b* each having one end connected to the first feeder line 26 on the left or right of the first feeder line 26, and a ground part 32 and stubs 34 formed on the first feeder line 26.

Each of the radiating elements 28*a*, 28*b*, 30*a* and 30*b*, which is formed to be bent in a certain shape, functions as a monopole antenna, and is a kind of radiator. A bent shape is not limited to an L-shape shown in the drawings, and can be variously modified to, for example, J-shape, F-shape and the like.

The radiating elements 28*a*, 28*b*, 30*a* and 30*b* are divided into the radiating elements 28*a* and 28*b* designed to be able to operate in a high frequency band, in practice, a 4.9 to 5.85 GHz frequency band, and the radiating elements 30*a* and 30*b* designed to be able to operate in a low frequency band, in practice, a 2.4 to 2.5 GHz frequency band. In this case, the radiating elements 28*a*, 28*b*, 30*a* and 30*b* have the same width. The radiating elements 30*a* and 30*b* operating in the low frequency band are designed to be longer than the radiating elements 28*a* and 28*b* operating in the high frequency band.

Preferably, the radiating elements operating in the same frequency band, for example, the radiating elements 28*a* and 28*b* or the radiating elements 30*a* and 30*b*, are arranged to form left-right symmetrical pairs around the first feeder line 26. Further, the radiating element pairs 28*a* and 28*b* operating in the high frequency band are arranged in an array structure longitudinally repeated at regular intervals, preferably, a four-array structure. The radiating element pair 30*a* and 30*b* operating in the low frequency band is arranged outside one of the radiating element pairs 28*a* and 28*b* arranged in the array structure at the same height. In this case, the position of the radiating element pair 30*a* and 30*b* operating in the low frequency band can be selected through repeated measurements for an optimal position where mutual interference between the radiating element pair 30*a* and 30*b* and the radiating element pairs 28*a* and 28*b* operating in the high frequency band is minimized.

The one or more stubs 34 are arranged at suitable positions on the first feeder line 26 and are designed to have widths greater than that of the first feeder line 26. Each of the stubs 34 performs an impedance matching tap function of matching the impedance of the first feeder line 26 with that of each of the radiating elements 28*a*, 28*b*, 30*a* and 30*b*, and performs a function of facilitating beam composition by delaying received signals to uniformly set all phases of the signals.

Referring to FIG. 3, the second conductive pattern 36 arranged on the rear surface 22 of the substrate 18 comprises a second feeder line 38 arranged on a longitudinal central line of the substrate 18, a plurality of radiating elements 40*a*, 40*b*, 42*a* and 42*b* connected to the second feeder line 38, and stubs 44 formed on the second feeder line 38.

The radiating elements 40*a*, 40*b*, 42*a* and 42*b* each forming a single radiator are up-down symmetrically arranged with respect to the radiating elements 28*a*, 28*b*, 30*a* and 30*b* formed on the first conductive pattern 24, respectively (refer to FIG. 4). Properly, the operating frequency ranges of the radiating elements 40*a*, 40*b*, 42*a* and 42*b* are the same as those of the radiating elements 28*a*, 28*b*, 30*a*, and 30*b* formed on the first conductive pattern 24, which are up-down symmetrically arranged with respect to the radiating elements 40*a*, 40*b*, 42*a* and 42*b*.

Referring to FIG. 4, reference numerals 46 and 48 designates a feeding hole and a conductive pin, respectively. The feeding hole 46 is formed to pass through the ground part 32 formed on the first feeder line 26, the substrate 18, and the second feeder line 38 in order.

Meanwhile, a coaxial transmission cable 12 provided with an internal core 15 and an external conductor 14 is provided to the antenna 16 in such a way that the core 15 passes through the feeding hole 46 to come into contact with the second feeder line 38, and the external conductor 14 is connected to the ground part 32 of the first feeder line 26 (refer to FIG. 1). Therefore, the radiating elements 28*a*, 28*b*, 30*a* and 30*b* on the first conductive pattern 24 and the radiating elements 40*a*, 40*b*, 42*a* and 42*b* on the second conductive pattern 36 represent different polarities. For example, if each of the radiating elements 28*a*, 28*b*, 30*a* and 30*b* on the first conductive pattern 24 represents a positive (+) polarity, each of the radiating elements 40*a*, 40*b*, 42*a* and 42*b* on the second conductive pattern 36 represents a negative (−) polarity. At this time, beams with different polarities are composed to obtain an omnidirectional radiation pattern.

The conductive pin 48 is provided to connect end portions of the first and second feeder lines 26 and 38 with each other. That is, the first and second feeder lines 26 and 38 are shorted at their end portions by the conductive pin 48 and are grounded through the ground part 32.

Figure 5:
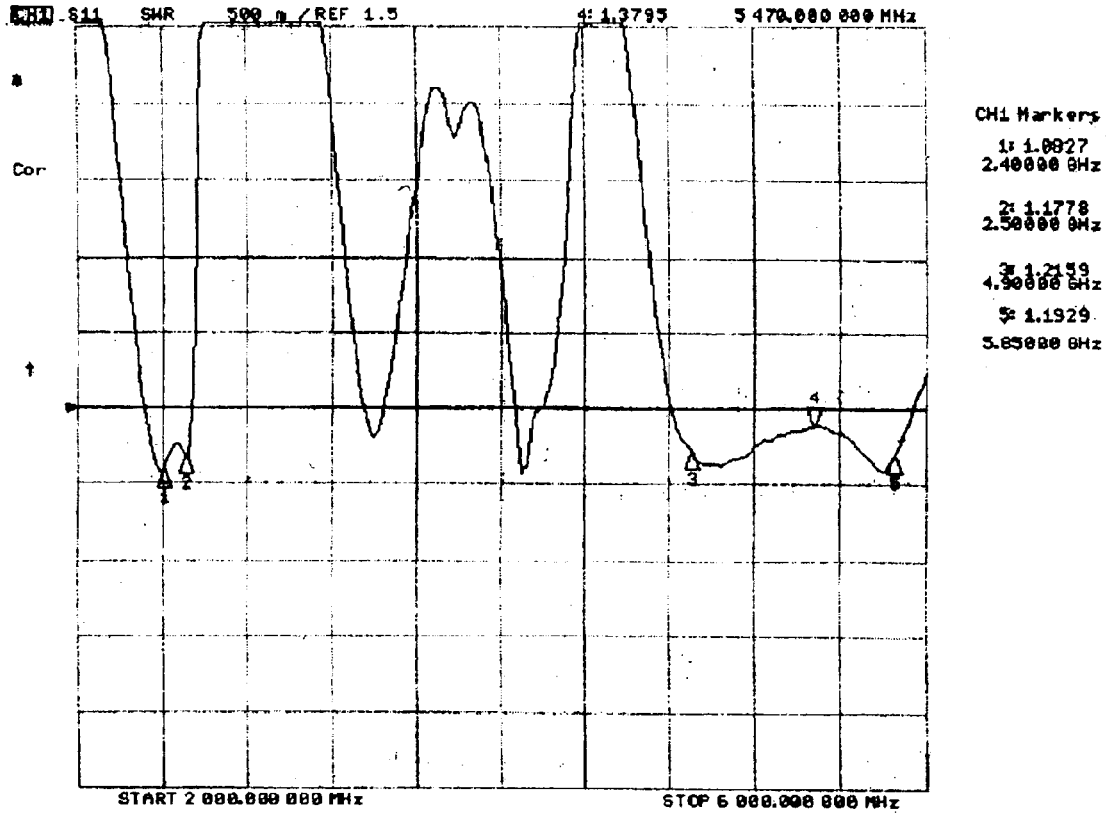
FIG. 5 is a graph showing results obtained by measuring Voltage Standing Wave Ratio (VSWR) of the antenna of FIG. 1 over a frequency band ranging from 2 GHz to 6 GHz.

Referring to FIG. 5, markers are located at the frequencies of 2.40, 2.50, 4.90, 5.45 and 5.85 GHz. FIG. 5 shows that a satisfactory VSWR less than or equal to 1.5:1 was measured in a 2.4 to 2.5 GHz frequency band and a 4.90 to 5.85 GHz frequency band. Therefore, it can be seen that the antenna 16 of the present invention has dual-band operating characteristics. Especially, as indicated in the measurement results, the antenna 16 has wideband characteristics in the 5 GHz frequency band. If it is considered that frequencies currently used in LAN systems according to countries and areas are various, for example, 2.40 to 2.50 GHz, 4.90 to 5.15 GHz, 5.15 to 5.45 GHz, 5.45 to 5.70 GHz, 5.725 to 5.825 GHz, etc., the wideband characteristics guarantee the general use of the antenna 16.

Figure 6A:
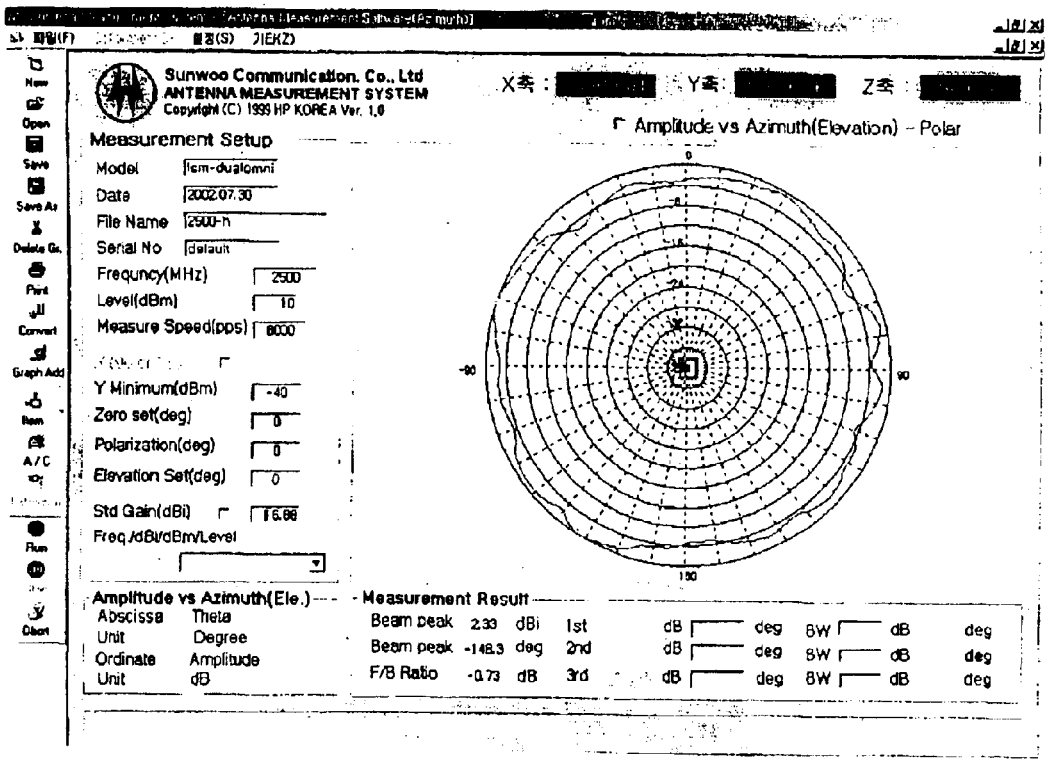
Figure 6B:
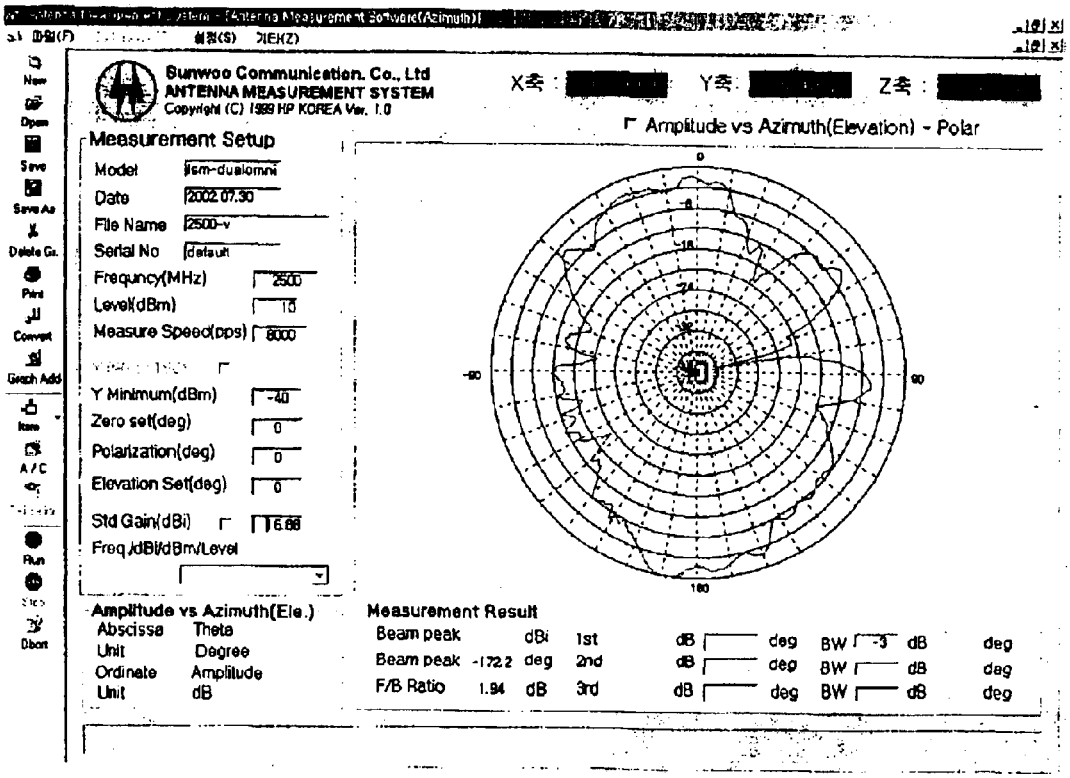

Referring to FIGS. 6*a* and 6*b* showing the results obtained by measuring the characteristics of the antenna 16 at the operating frequency of 2.5 GHz, a horizontal radiation pattern (FIG. 6*a*) showed an approximately circular pattern, while a vertical radiation pattern (FIG. 6*b*) showed a figure-8 pattern, representing omnidirectional characteristics of a frequency only antenna. Accordingly, it can be proved that the antenna 16 has omnidirectional radiation characteristics. Further, a peak gain was measured to be 2.33 dBi.

Figure 7A:
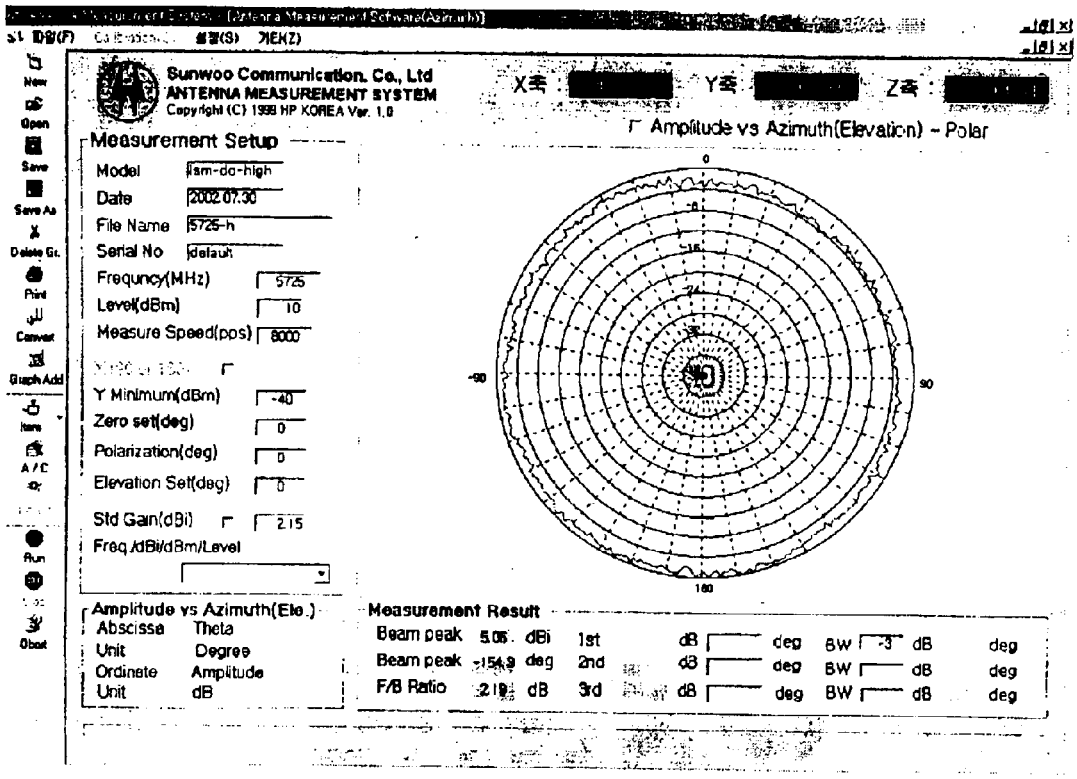
Figure 7B:
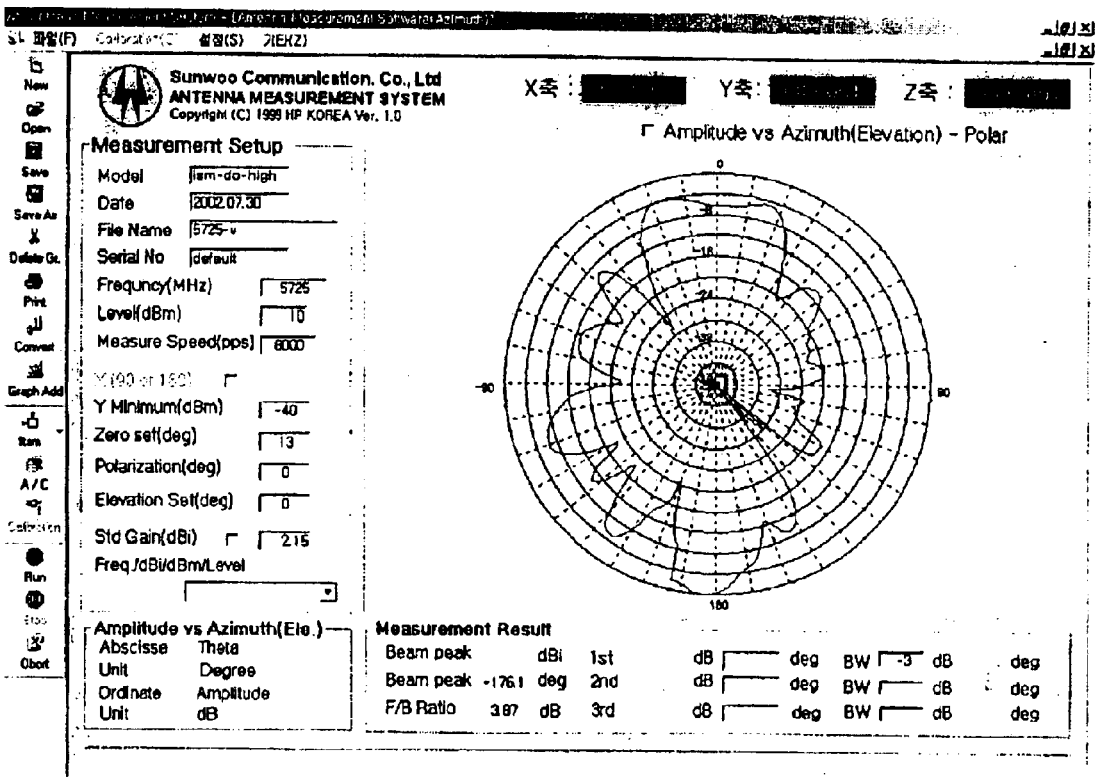

Referring to FIGS. 7*a* and 7*b* showing the results obtained by measuring the characteristics of the antenna 16 at the operating frequency of 5.725 GHz, a horizontal radiation pattern (FIG. 7*a*) showed an approximately circular pattern, while a vertical radiation pattern (FIG. 7*b*) showed a figure-8 pattern, representing omnidirectional characteristics of a frequency only antenna. Accordingly, it can be proved that the antenna 16 has omnidirectional radiation characteristics. Gain uniformity of this measurement was superior to that of the measurement at the operating frequency of 2.5 GHz, wherein a peak power gain was measured to be 5.06 dBi.

As described above, the present invention provides a dual-band omnidirectional antenna for wireless LANs, which has characteristics enabling the antenna to effectively operate in different frequency bands. Accordingly, the present invention is economically advantageous in that it can be compatibly used in various wireless LAN systems using different frequency bands. Further, the antenna of the present invention is advantageous in that, since it is designed as a microstrip type and it uses a single coaxial transmission cable, the antenna can be miniaturized and manufactured at low cost.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A dual-band omnidirectional antenna for wireless Local Area Networks (LANs), comprising:

a planar dielectric substrate with first and second surfaces parallel with each other;

a first conductive pattern arranged on a first surface of the substrate, and provided with a first feeder line arranged on a longitudinal central line of the substrate and a plurality of radiating elements which are formed to be bent, which have one ends connected to the first feeder line, and which are designed such that some of the radiating elements operate in a high frequency band, and others thereof operate in a low frequency band; and a second conductive pattern arranged on the second surface of the substrate, and provided with a second feeder line arranged on a longitudinal central line of the substrate and a plurality of radiating elements connected to the second feeder line and up-down symmetrically arranged with respect to the radiating elements on the first conductive pattern, wherein a coaxial transmission cable having an external conductor and a core is provided to the antenna in a relation in which the external conductor comes into contact with a ground part on the first feeder line, and the core comes into contact with the second feeder line.

2. The dual-band omnidirectional antenna for wireless LANs according to claim 1, further comprising a feeding hole passing though the ground part on the first feeder line, the substrate and the second feeder line in order, wherein the coaxial transmission cable is provided in a relation in which the core passes through the feeding hole to come into contact with the second feeder line, and the external conductor comes into contact with the ground part.

3. The dual-band omnidirectional antenna for wireless LANs according to claim 1, wherein the first and second feeder lines are shorted by a conductive pin used to connect end portions of the first and second feeder lines with each other.

4. The dual-band omnidirectional antenna for wireless LANs according to claim 1, wherein the high frequency band is a 4.9 to 5.85 GHz frequency band, and the low frequency band is a 2.4 to 2.5 GHz frequency band.

5. The dual-band omnidirectional antenna for wireless LANs according to claim 1, wherein all radiating elements on the first and second conductive patterns have the same width, and the radiating elements operating in the low frequency band are formed to be longer than those operating in the high frequency band.

6. The dual-band omnidirectional antenna for wireless LANs according to claim 1, wherein the radiating elements operating in the same frequency band are arranged to form left-right symmetrical pairs around the first and second feeder lines.

7. The dual-band omnidirectional antenna for wireless LANs according to claim 6, wherein radiating element pairs operating in the high frequency band are arranged on each of the first and second feeder lines in an array structure longitudinally repeated at regular intervals, and a radiating element pair operating in the low frequency band is arranged outside one of the radiating element pairs arranged in the array structure at the same height.

8. The dual-band omnidirectional antenna for wireless LANs according to claim 7, wherein the first and second feeder lines each have one or more stubs arranged thereon.

* * * * *